United States Patent [19]

Tschudi

[11] 4,100,942

[45] Jul. 18, 1978

[54] DRIVE, CONTROL AND MONITORING DEVICE FOR LOOMS

[75] Inventor: Rudolf Tschudi, Wald, Switzerland

[73] Assignee: Ruti Machinery Works Ltd., Ruti, Switzerland

[21] Appl. No.: 726,004

[22] Filed: Sep. 23, 1976

[30] Foreign Application Priority Data

Sep. 30, 1975 [CH] Switzerland ..... 12645/75

[51] Int. Cl.[2] ..... D03D 51/00

[52] U.S. Cl. ..... 139/1 R; 139/336; 139/341

[58] Field of Search ..... 139/341–343, 139/336, 1 R, 1 E

[56] References Cited

U.S. PATENT DOCUMENTS

| | | | |
|---|---|---|---|
| 2,119,413 | 5/1938 | Batchelder | 139/1 R |
| 2,858,855 | 11/1958 | Picanol | 139/1 E |
| 3,498,339 | 3/1970 | Davis et al. | 139/336 |
| 3,570,550 | 3/1971 | Budzyna | 139/1 R |
| 3,613,742 | 10/1971 | Ainsworth et al. | 139/341 X |
| 3,757,831 | 9/1973 | Loepfe et al. | 139/336 |
| 3,805,849 | 4/1974 | Steverlynck | 139/341 X |

*Primary Examiner*—James Kee Chi

*Attorney, Agent, or Firm*—Donald D. Denton

[57] ABSTRACT

A drive, control, and monitoring device for looms in which there is a drive motor connected to the power line, a flywheel operatively connected with the drive motor, an electromagnetic brake and clutch unit arranged between the flywheel and the crankshaft of the loom, and a means for controlling and monitoring the weaving process.

4 Claims, 1 Drawing Figure

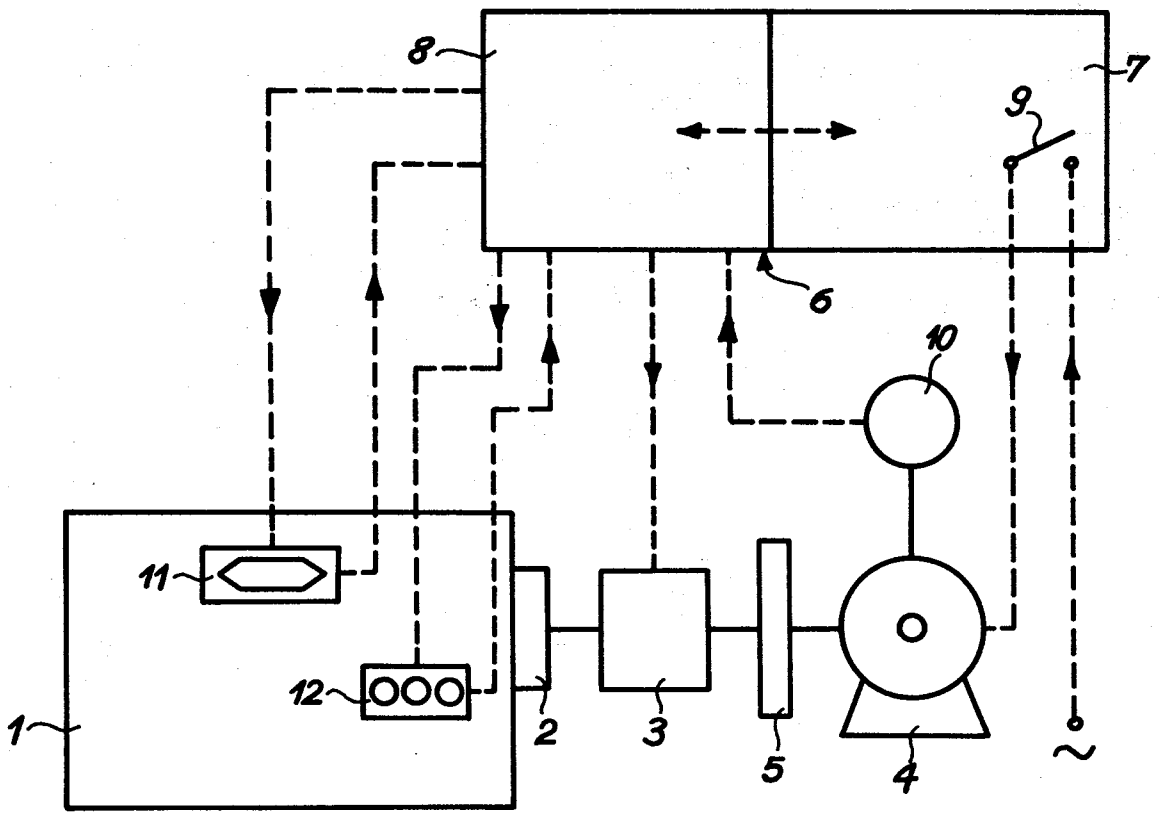
7
9
10
6
8
4
5
3
2
12
11
1

DRIVE, CONTROL AND MONITORING DEVICE FOR LOOMS

Background of the Invention

The present invention relates to a drive, control, and monitoring device for looms, having a drive motor connected to the power line, a flywheel operatively connected with the drive motor, an electromagnetic brake and clutch unit arranged between the flywheel and the crankshaft of the loom, and a means for controlling and monitoring the weaving process.

Devices of this type are known and are generally used today in looms. In weaving practice, a large number of such driven looms, for instance about 50, are operated by a single person. It is obvious that the fewest possible machine shut-downs or standstills should occur upon the operation of the looms. Viewed from the standpoint of the loom operators, those shut-downs which affect several machines simultaneously are particularly undesirable.

Machine shut-downs of this type occur, in particular, in case of interruptions in current caused by powerline overload or by thunderstorms. These interruptions of current as a rule have a duration of fractions of a second; but because the clutch part of the electromagnetic brake and clutch unit is without current, they lead to the shutting down of all looms. After the end of the interruption of the current, the looms must be started again by hand.

SUMMARY OF THE INVENTION

The object of the present invention is to provide a drive device for looms, upon the use of which the looms are not disconnected in case of brief interruptions of current.

This is achieved in accordance with the invention by means of providing an additional source of current to which are connected the control and monitoring means provided for the feeding and control of the clutch part of the electromagnetic brake and clutch unit and for the monitoring of the weaving process.

By means of the additional source of current in accordance with the invention, brief interruptions of current can be bridged-over in simple manner with the loom continuing in operation without interruption by providing a flywheel in which an amount of kinetic energy is stored sufficient to drive the loom for the duration of the short interruption in the current. This is accomplished by having the control and monitoring means permanently connected to the additional source of current and therefore fed by the latter even in normal operating condition. This system has the additional advantage that all other factors of disturbance possibly occurring in the power line are also overcome by this control and monitoring means.

A preferred embodiment of the invention is characterized by the fact that the additional source of current may be formed by a generator which is permanently coupled with the drive motor.

BRIEF DESCRIPTION OF THE DRAWING

The invention will be described below on the basis of an illustrative embodiment shown in the drawing, in which:

FIG. 1 is a schematic representation of the drive, control, and monitoring device for looms of this invention.

DESCRIPTION OF PREFERRED EMBODIMENT

In FIG. 1 mechanical connections are indicated by solid lines, and electrical connections by dashed lines. In accordance with FIG. 1, a loom 1 is connected via a stepdown gearing means 2 with an operatively connected electromagnetic brake and clutch unit 3. By means of the brake and clutch unit 3, the loom 1 can be connected to a flywheel 5 which is in turn operatively connected to a motor 4. The connection between the motor 4 and the flywheel 5 can, for instance, be formed by V-belt.

A control unit 6 is associated with the loom 1 and the motor 4. The control unit 6 consists of a power-supply part 7 and of the control part 8 which supplies current for the operation of motor 4 as shown by the dash line entering and leaving the power-supply part 7. The power-supply part 7 is connected to the power line via a main switch 9. It will be appreciated that any conventional power-supply part may be used that is capable of supplying electrical current to motor 4 when main switch 9 is closed. Exemplary of one of the many systems showing such supply parts is presented in U.S. Pat. No. 3,805,849 and is illustrated in detail in FIG. 4 of the drawings.

On the drive shaft of the motor 4 there is arranged a generator 10, which is electrically connected with the control part 8 by a line. It will be appreciated that generator 10 may be any conventional type of generator that is capable of producing current such as by cutting magnetic lines of force by the turning of a rotor operatively connected to the motor 4, so that there is a constant supply of electrical current to the control part 8. Control part 8 may be of conventional design and U.S. Pat. No. 3,805,849 describes such a control part and illustrates it in FIG. 3 of the drawings (see dash line which indicates electrical lines). The control part 8 in its turn is electrically connected via lines with the electromagnetic brake and clutch unit 3, with one or more shuttle flight controls 11 mounted on the loom 1, and with additional control and monitoring means 12 for control of the sequence of weaving during operation of the weaving process.

The electrical energy is obtained from the power line for the operation of the motor 4 and for operation of a part of the control unit 6. The motor may be an asynchronous motor or may be any type of motor that when operatively connected to the generator will produce electrical energy. On operation of motor 4, mechanical energy is imparted to the flywheel 5 by the rotation of the flywheel, which may be accomplished by a V-belt drive, then to the electromagnetic brake and clutch unit 3, to the step-down gearing 2, and to the loom 1. The motor 4 operates continuously, and all mechanical movements of the machine are affected under the control of the electromagnetic brake and clutch unit 3.

The flywheel 5 serves, in cooperation with the motor 4, to bring the loom 1 rapidly to the desired speed of rotation upon starting. Furthermore, the flywheel 5 is so dimensioned that the kinetic energy stored in it when the loom is operating can fully maintain the existing continuous operation under load, even upon failure of the line voltage for a period of time of about 0.5 second. This means that the turning of the flywheel, brake and clutch unit, the step-down gearing and the shaft of the loom do not lose the power necessary for their operation during the running of the loom.

Due to the rotation of the drive shaft of the motor 4, the electric energy necessary for the operation of the clutch part of the electromagnetic brake and clutch unit 3 and for the operation of the control and monitoring means 11 and 12 is produced by the operation of the generator 10. The electrical energy produced by the operation of generator 10, whether by electrical excitation of the motor or by the releasing of the kinetic energy stored in the flywheel, is supplied to the control part 8. The electrical energy produced by the generator 10 is fed to all of the energy-consuming devices via the control part 8. Thus it can be seen that the control part 8 of control unit 6 can be any electrical device capable of distributing the electric current produced by the generator 10 to operate the electromagnetic brake and clutch unit 3, and the control and monitoring means 11 and 12 so that the loom will function in its designed manner during operation when the generator is driven by motor 4 being electrically energized or during brief moments of power failure when the generator is driven by the kinetic energy stored in the flywheel, which is a means for producing additional source of current to the control and monitoring means 11 and 12.

By the apparatus described, in combination with a suitable development of the control unit, the result is obtained that the looms 1 are not shut down in case of brief failures in the line power, particularly upon thunder storms. In the event of power line failures, the loss of power is bridged over by the continuous operation of generator 10 which continues to be energized by the kinetic energy stored in the flywheel 5, thus fully assuring that the monitoring and control units of the weaving process are properly energized during the time delay period.

By the supplying of the generated current for the control and monitoring means 11 and 12 and the greatest part of the control unit 6 by means of the generator 10, the said stages are furthermore rendered very insensitive to minor disturbances in the power line system.

It will be appreciated that means other than a generator may be used to assure the continuous supply of electrical energy during momentary cut-off of line electrical energy. For example, the electrical energy necessary for the feeding of the brake part of the electromagnetic brake and clutch unit 3 may be stored in capacitors. In this way, assurance is had that the braking will take place at the correct moment in all cases, and therefore will bridge over the momentary power-line failures to keep the looms running.

The function of the generator 10 can, in principle, also be assumed by a correspondingly dimensioned battery of capacitors.

In the above description the designation "shuttle flight controls" has been used. This expression however is not to be understood in a limitative sense, since the generator proposed can be used in connection with all types of methods of insertion of the filling yarn.

It will be appreciated that various changes and/or modifications may be made within the skill of the art without departing from the spirit and scope of the invention illustrated, described, and claimed herein.

What is claimed is:

1. A drive, control, and monitoring device for looms comprising a drive motor connected to the power line, a flywheel operatively connected with the drive motor, an electromagnetic brake and clutch unit operatively positioned between the flywheel and the crankshaft of the loom, means for controlling and monitoring the weaving process, and means for producing additional source of current to the control and monitoring means to provide electrical energy for the controling of the clutch part of the electromagnetic brake and clutch unit and for the monitoring of the weaving process.

2. The drive, control and monitoring device according to claim 1 in which means for producing the additional source of current is a generator operatively connected with the drive motor.

3. The drive, control and monitoring device according to claim 2 in which the generator is mounted on the drive shaft of the drive motor.

4. The drive, control and monitoring device according to claim 3 in which the flywheel is so dimensioned that it stores sufficient kinetic energy in it during the operation of the loom to provide for the continuous operation under load of the loom for a period of up to about one second upon momentary failure of current to the motor.

* * * * *